US008561722B2

(12) United States Patent
Parlin

(10) Patent No.: US 8,561,722 B2
(45) Date of Patent: Oct. 22, 2013

(54) METHODS OF CONTROLLABLY MILLING A WINDOW IN A CASED WELLBORE USING A PRESSURE DIFFERENTIAL TO CAUSE MOVEMENT OF A MILL

(75) Inventor: Joseph Parlin, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/590,988

(22) Filed: Aug. 21, 2012

(65) Prior Publication Data

US 2013/0153224 A1 Jun. 20, 2013

Related U.S. Application Data

(63) Continuation of application No. PCT/US2011/066263, filed on Dec. 20, 2011.

(51) Int. Cl.
*E21B 7/04* (2006.01)

(52) U.S. Cl.
USPC ..... 175/61; 175/75; 175/81; 166/255.3

(58) Field of Classification Search
USPC ..... 166/298, 55.6, 117.5, 50, 255; 175/61, 175/75, 81, 425, 62
See application file for complete search history.

(56) References Cited

U.S. PATENT DOCUMENTS

| | | | | |
|---|---|---|---|---|
| 5,810,079 | A * | 9/1998 | Lynde et al. | 166/55.6 |
| 6,070,670 | A | 6/2000 | Carter et al. | |
| 6,105,675 | A | 8/2000 | Buytaert et al. | |
| 6,286,614 | B1 | 9/2001 | Gano et al. | |
| 6,920,945 | B1 | 7/2005 | Belew et al. | |
| 6,926,102 | B2 | 8/2005 | Hess et al. | |
| 2004/0168829 | A1 | 9/2004 | Hess et al. | |
| 2010/0224367 | A1 * | 9/2010 | Brunet et al. | 166/298 |
| 2010/0314107 | A1 | 12/2010 | Vestavik | |

OTHER PUBLICATIONS

Durst, et al., Subsea Downhole Motion Compensator: Field History, Enhancements, and the Next Generation, Society of Petroleum Engineers, IADC/SPE 59152, Feb. 2000.

* cited by examiner

*Primary Examiner* — Yong-Suk (Philip) Ro
(74) *Attorney, Agent, or Firm* — Paul Herman; Sheri Higgins Law; Sheri Higgins

(57) ABSTRACT

A method of controllably milling a window in at least a portion of a cased wellbore comprises: interconnecting a mill advancing device and a mill; applying a pressure differential between the mill advancing device and the mill, wherein the application of the pressure differential causes a downward movement of the mill advancing device and the mill; and causing the mill to engage the at least a portion of the cased wellbore.

23 Claims, 3 Drawing Sheets

METHODS OF CONTROLLABLY MILLING A WINDOW IN A CASED WELLBORE USING A PRESSURE DIFFERENTIAL TO CAUSE MOVEMENT OF A MILL

CROSS-REFERENCE TO RELATED APPLICATION

This application is a continuation of and claims priority to PCT Application No. PCT/US11/66263, filed on Dec. 20, 2011.

TECHNICAL FIELD

Methods of controllably milling a window in at least a portion of a cased wellbore include applying a pressure differential between a mill advancing device and a mill. According to an embodiment, a pressurization annulus is formed at a location above the mill between a seal and the mill advancing device. The application of the pressure differential can cause a downward movement of the mill advancing device and the mill. According to an embodiment, movement of the mill advancing device causes movement of a drill string, which causes movement of the mill.

SUMMARY

According to an embodiment, a method of controllably milling a window in at least a portion of a cased wellbore comprises: interconnecting a mill advancing device and a mill; applying a pressure differential between the mill advancing device and the mill, wherein the application of the pressure differential causes a downward movement of the mill advancing device and the mill; and causing the mill to engage the at least a portion of the cased wellbore.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
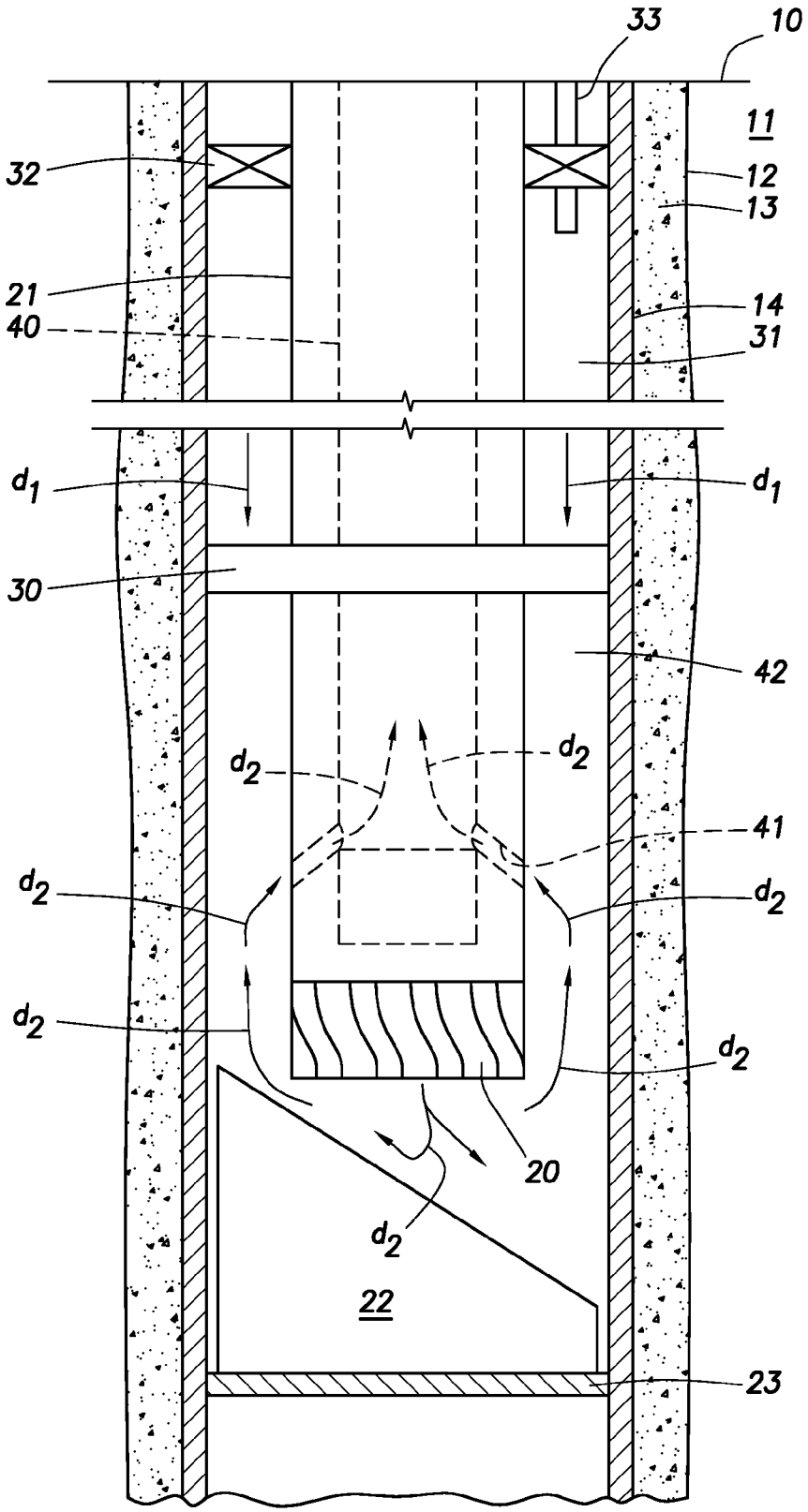
FIG. 1 is a schematic of a well system including a mill and a mill advancing device.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more fluid inlets, pressures, etc., as the case may be, and does not indicate any sequence. Furthermore, it is to be understood that the mere use of the term "first" does not require that there be any "second," and the mere use of the term "second" does not require that there be any "third," etc.

As used herein, the relative term "down", and all grammatical variations thereof, means in a direction away from the wellhead. Conversely, the relative term "up", and all grammatical variations thereof, means in a direction towards the wellhead. Moreover, the term "below" means at a location farther away from the wellhead compared to another location; and the term "above" means at a location closer to the wellhead compared to another location. By way of example, reference to a mill being below another component or device means that the mill is at a location farther away from the wellhead compared to the other component or device.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas.

Oil and gas hydrocarbons are naturally occurring in some subterranean formations. A subterranean formation containing oil or gas is sometimes referred to as a reservoir. A reservoir may be located under land or off shore. In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. It is common for a well to include a primary wellbore and one or more lateral wellbores extending from the primary wellbore. As used herein, the term "wellbore" also means any wellbore whether it be a primary wellbore or a lateral wellbore. As used herein, "into a well" means and includes into any portion of a wellbore, including into a primary wellbore and/or into one or more lateral wellbores.

A drill bit can be used to form a primary wellbore. A drill string can be used to aid the drill bit in drilling through the subterranean formation to form the wellbore. The drill string can include a drilling pipe. During drilling operations, a drilling fluid, sometimes referred to as a drilling mud, may be circulated downwardly through the drilling pipe, and back up the annulus between the wall of the wellbore and the outside of the drilling pipe. The drilling fluid performs various functions, such as cooling the drill bit, maintaining the desired pressure in the well, and carrying drill cuttings upwardly through the wellbore annulus.

After the primary wellbore is drilled, a tubing string, called casing, can be placed into the wellbore. The casing can be cemented in the wellbore by introducing a cement composition in the annulus between the wall of the wellbore and the outside of the casing. The cement can help stabilize and secure the casing in the wellbore.

In order to form a lateral wellbore, a window can first be created. This is generally accomplished by placing a mill in the primary wellbore. The mill includes a mill bit, which can be the same as, or similar to, the drill bit that was used to form the primary wellbore. The mill can be attached to a drill string which is located inside the casing. A drilling fluid is circulated downwardly through the drill string and up through the annular space between the outside of the drill string and the inside of the casing. A mill diverter can be placed at a location adjacent to the desired window location. An example of a common mill diverter is a whipstock. The mill diverter includes a sloped portion, much like the hypotenuse of a right triangle. The mill diverter can be secured to the inside of the casing and prevented from moving, for example via a packer. The mill is then advanced through the primary wellbore until it engages the sloped portion of the mill diverter. The mill is then directed laterally, i.e., in a direction away from a central axis of the primary wellbore, towards the casing. The grade of the sloped portion of the mill diverter can dictate how quickly the mill comes in contact with the casing and also the length of the window. The mill is advanced down the mill diverter until the mill has cut through the casing and the cement, and penetrates the subterranean formation. The mill bit, or a different drill bit, can be used to extend the lateral wellbore a desired distance into the subterranean formation. A casing or liner can then be inserted into the lateral wellbore. The casing or liner can be connected to the casing in the primary wellbore such that fluid is directed from the lateral wellbore and into the primary wellbore (or vice versa), without fluid leakage into the formation. The casing or liner can also be cemented in the lateral wellbore in the same manner as cementing was performed in the primary wellbore.

Of course there can be more than one lateral wellbore formed. There can also be one or more secondary laterals that extend off of a primary lateral to create a branching network of wellbores. As used herein, the term "lateral wellbore" means a wellbore that extends off of a primary wellbore or off of another lateral wellbore, for example, a secondary, tertiary, and so on, lateral wellbore.

Issues can arise during window formation. One example of such an issue is a fluctuation in the weight applied to the mill during window formation. Traditionally, the mill is pushed through a wellbore and into the casing by force being exerted on the drill string. The force is commonly applied to the drill string at or above the wellhead. Depending on the distance between where the force is applied and the mill bit, the force may not always be transferred to the mill bit uniformly. Moreover, in off-shore drilling, it is common for the drilling rig platform to be located at the surface of the water several hundreds to thousands of feet above the wellhead (commonly called a floating rig); and the mill bit may then be several hundreds to thousands of feet below the wellhead. Additionally, in rough seas, the drill string, which is suspended from the rig platform, may undesirably rise and fall due to a heaving motion of the rig. This heaving motion can cause uneven and/or undesirable excess weight to be applied to the mill.

It is important for the window to: be as straight as possible; be the desired length; and begin and end at the desired locations. When the amount of weight placed on the mill fluctuates, or when too much weight is placed on the mill, then the window can become jagged, curve, be too short or too long, or begin and/or end at an undesired location. Devices, such as rig heave compensators, have been used to help minimize fluctuations in weight or reduce excess weight placed on a drill bit during drilling operations. However, such devices do not fully eliminate all fluctuations or excess weight. Moreover, the greater the distance between the application of weight on the drill string and the bit, the less effective these devices become.

Thus, there is a need for being able to more effectively control the amount of weight placed on a mill during the formation of a window. A novel method of forming a window includes using a mill advancing device to apply weight to, and cause movement of, the mill. The weight placed on the mill is applied via the mill advancing device instead of being applied to the drill string at the rig floor. Therefore, less distance exists between the mill and where the force is being applied. This decreased distance reduces or eliminates fluctuations in weight and/or excess weight being applied to the mill.

According to an embodiment, a method of controllably milling a window in at least a portion of a cased wellbore comprises: interconnecting a mill advancing device and a mill; applying a pressure differential between the mill advancing device and the mill, wherein the application of the pressure differential causes a downward movement of the mill advancing device and the mill; and causing the mill to engage the at least a portion of the cased wellbore.

Any discussion of a particular component of the system (e.g., a fluid inlet) is meant to include the singular form of the component and also the plural form of the component, without the need to continually refer to the component in both the singular and plural form throughout. For example, if a discussion involves "the fluid inlet," it is to be understood that the discussion pertains to one fluid inlet (singular) and two or more inlets (plural). It is also to be understood that any discussion of a particular component or particular embodiment regarding a component is meant to apply to all of the method embodiments without the need to re-state all of the particulars for each of the method embodiments.

Turning to the Figures, FIG. 1 is a diagram of a well system. The system includes a wellbore 12 and a wellhead 10. The wellbore 12 extends down into a subterranean formation 11. The wellbore 12 can be a primary wellbore or a lateral wellbore. The wellbore 12 can have vertical, horizontal, inclined, straight, or curved sections, and combinations thereof. At least a section of the wellbore 12 is a cased-hole wellbore. The cased-hole section can include a casing 14. The casing 14 can be cemented in the wellbore 12 via cement 13.

The system can include a mill diverter 22. An example of a mill diverter 22 is a whipstock. The mill diverter 22 can be placed in the wellbore 12 inside the casing 14. The mill diverter 22 can be secured to the casing 14 via an anchoring device 23. Examples of a suitable anchoring device 23 include, but are not limited to, a packer, a latch, a liner hanger, or a collet. The anchoring device 23 can function to secure the mill diverter 22 within the casing 14 at the desired location such that downward and rotational movement of the mill diverter 22 under force is inhibited, and preferably eliminated. The methods can further include the step of securing the mill diverter 22 in the casing adjacent to the portion of the cased wellbore, wherein the step of securing can be performed prior to the step of applying the pressure differential.

The mill diverter 22 can include a sloped portion. During milling operations, a mill 20 can be guided towards the mill diverter 22. The mill 20 can include a mill bit (not shown). The mill bit is designed to cut solid materials, such as metal and set cement, and break the solid materials up into small pieces. The mill 20 can be connected to a tubing work string, such as a drill string 21. The drill string 21 can be used to pump a drilling fluid to the mill 20 and mill bit. The drilling fluid functions to lubricate and cool the mill bit, as well as remove cuttings from the annulus located between the inside of the casing 14 and the outside of the drill string 21.

Figure 2:
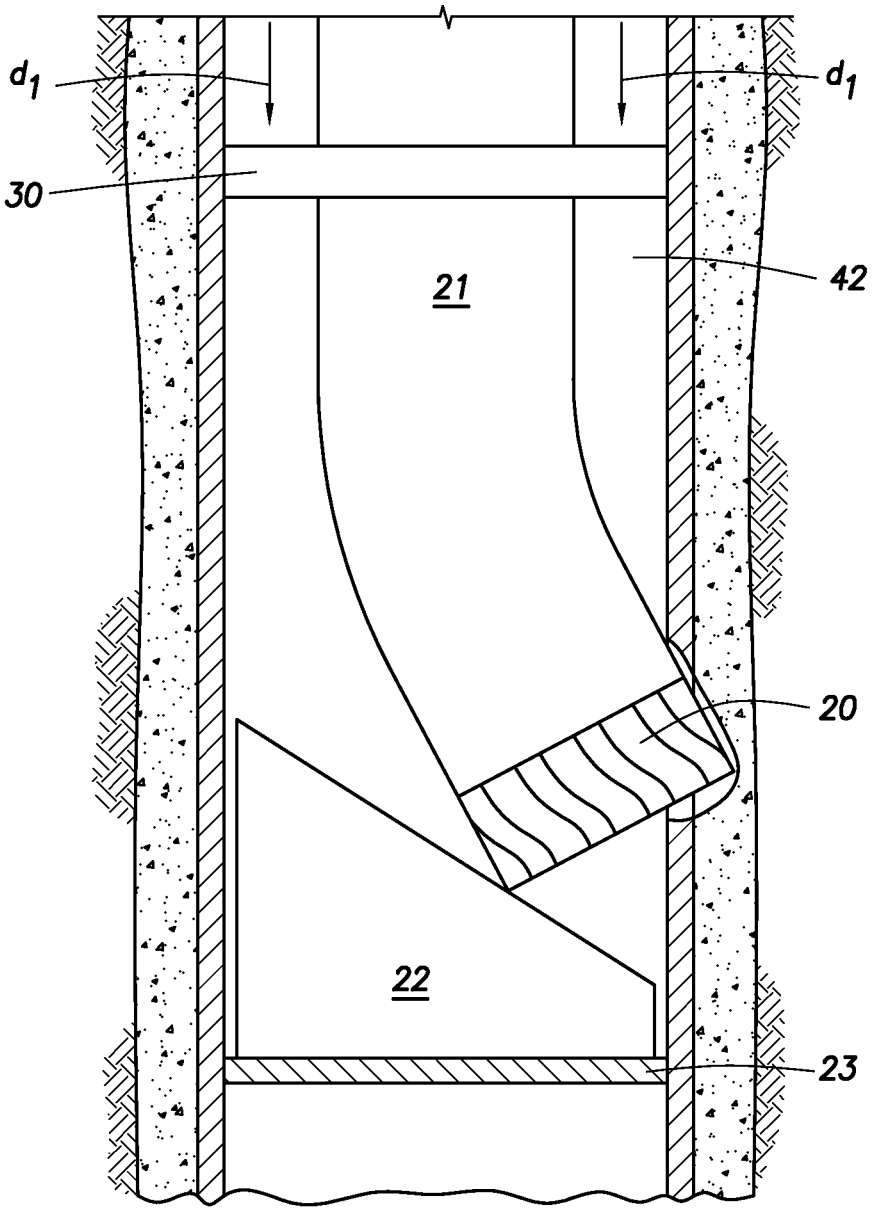
FIG. 2 depicts the mill engaging a portion of a casing in a cased wellbore portion.
Figure 3:
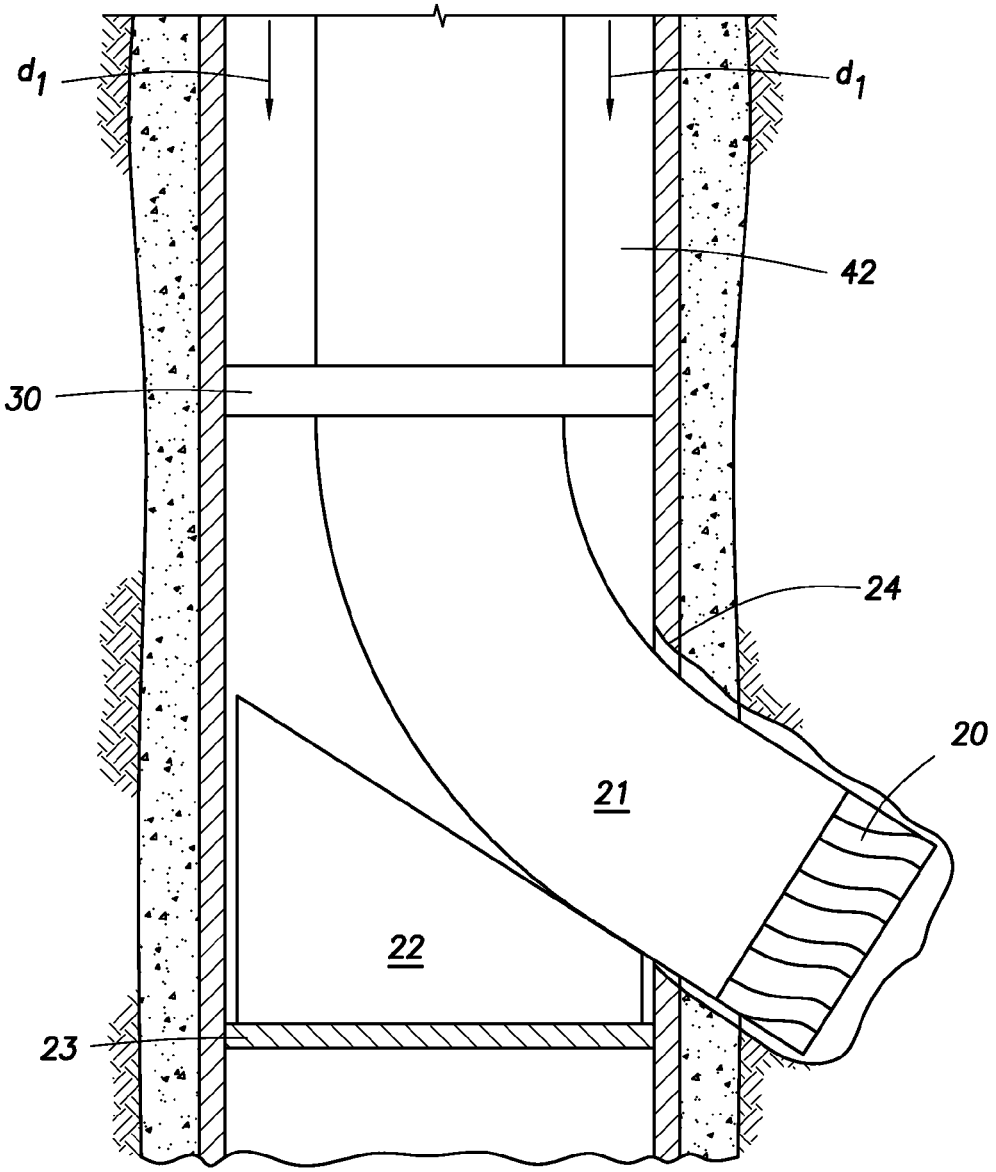
FIG. 3 shows a window completed in the cased wellbore using the mill and the mill advancing device.

As can be seen in FIG. 2, the mill 20, upon encountering the sloped portion of the mill diverter 22, can be diverted away from the center axis of the casing 14. In this manner, the mill bit can start to engage a portion of the casing 14 adjacent to the mill diverter 22. The mill bit can start to break up the casing and the set cement. As the mill continues advancing, the window becomes longer. As can be seen in FIG. 3, the mill is advanced until the desired window has been formed. The grade of the sloped portion of the mill diverter 22 can vary and can be used to help define the length of a window. The grade of the slope can also help define the beginning of the window 24. The grade of the slope of the mill diverter 22 typically can range from about 2° to about 5°. According to an embodiment, the grade of the slope of the mill diverter 22 is selected such that a window is formed at the desired location and is the desired length.

The system includes the mill 20 and a mill advancing device 30. According to an embodiment, the methods include the step of interconnecting the mill advancing device 30 and the mill 20. According to an embodiment, the mill advancing device 30 is interconnected to the mill 20 such that movement of the mill advancing device 30 causes movement of the mill 20. By way of example, the mill advancing device 30 can be interconnected to the mill 20 via the drill string 21. The mill advancing device 30 can be connected to the drill string 21 in a variety of ways, including, but not limited to, a collet, threaded, bonded through chemical reactions or heat, held in place with screws or pins, welded or brazed, and splined. Preferably, the mill advancing device 30 is connected to the drill string 21 in a manner such that movement of the mill advancing device 30 causes movement of the drill string 21. According to another method, the drill string 21 would be coupled with a downhole rotation device (not shown), such as a mud motor. The downhole rotation device could preclude the need to rotate the drill string 21 between the mill 20 and the wellhead 10. The rotation device could be placed below or above the mill advancing device 30. This could be used to control the transfer of torque in deep or highly deviated wells. In this manner, the mill advancing device 30 could then be used to provide a controlled axial load on the mill 20, and the fluid flow of the downhole rotation device could be used to control the torque on the mill 20. According to another embodiment, the mill advancing device 30 is connected to the drill string 21 such that a seal is created around the outer diameter of the drill string 21 at the location of the mill advancing device 30. In this manner, fluids are prevented from flowing in the annulus between the outside of the drill string 21 and the inside of the casing 14 at the location of the mill advancing device 30.

The mill advancing device 30 can be connected to the casing 14. According to an embodiment, the mill advancing device 30 is connected to the casing 14 such that a seal is created between the outside of the mill advancing device 30 and the inside of the casing 14. The mill advancing device 30 can be slidingly connected to the casing 14. In this manner, the mill advancing device 30 is capable of moving downwards along the inside of the casing 14. The mill advancing device 30 can be lubricated (e.g., via a drilling fluid) to facilitate movement of the mill advancing device 30 downwards along the inside of the casing 14. According to an embodiment, the mill advancing device 30 is connected to the drill string 21 such that movement of the mill advancing device 30 causes movement of the drill string 21; and the mill advancing device 30 is also slidingly connected to the casing 14. Preferably, the mill advancing device 30 creates a seal in the annulus between the outside of the drill string 21 and the inside of the casing 14 at the location of the mill advancing device 30. In this manner, fluid is prevented from flowing from a pressurization annulus 31 to a casing annulus 42. The methods can further include the step of positioning the mill advancing device 30 and the mill 20 in the wellbore prior to the step of applying the pressure differential.

It can be common for a well system to include multiple tubing strings having different sizes, for example a 4 inch string versus a 6 inch string. One of the tubing strings can be the casing 14 and any additional tubing strings can be located inside the casing. The size of the string can indicate the outer diameter (O.D.) of the string. It may also be common for a mill to move downward in a wellbore from a first tubing string having a first O.D. to a second tubing string having a second O.D. According to an embodiment, the mill advancing device 30 is positioned in a tubular having the same (inner diameter) I.D. as the tubular that the mill 20 is positioned in, i.e., the mill advancing device 30 and the mill 20 are both positioned in the same sized tubular. The mill advancing device 30 can include an expandable and/or retractable outer diameter (O.D.). By way of example, if the first I.D. of the first tubing string (not shown) is smaller than the second I.D. of the second tubing string (e.g., the casing 14), then as the mill advancing device 30 moves from the first I.D. to the second I.D., the O.D. of the mill advancing device 30 can be expanded to create a seal in the annulus between the I.D. of the second tubing string and the O.D. of the drill string 21 at the location of the mill advancing device 30.

The system can further include a seal 32. The seal 32 can be made of a variety of materials, including, but not limited to, rubber or other natural elastomers, polymers, composite material, metals, man-made elastomers or combinations thereof. Examples of a suitable seal 32 include, but are not limited to, a packer, an O-ring, a T-seal, or a crimp seal. Preferably, the seal 32 and the mill advancing device 30 are capable of creating the pressurization annulus 31. According to an embodiment, the pressurization annulus 31 is located between the bottom of the seal 32 and the top of the mill advancing device 30. The casing annulus 42 can be located below the mill advancing device 30.

According to an embodiment, the seal 32 is located above the mill advancing device 30. The seal 32 can be positioned at the wellhead 10, for example, as a blow-out preventer (BOP). The seal 32 can also be located at a position below the wellhead 10 and above the mill advancing device 30. Preferably, the seal 32 is located at a position such that the desired amount of pressure can be maintained in the pressurization annulus 31. According to an embodiment, the seal 32 is stationary.

The system can further include a fluid inlet 33. The system can include two or more fluid inlets 33. The fluid inlet 33 can be used to introduce a fluid into the pressurization annulus 31. Accordingly, the fluid inlet 33 can be located in the well system such that a fluid is capable of being introduced into the pressurization annulus 31, for example, at a location between the seal 32 and the mill advancing device 30. According to an embodiment, the fluid is used to create a first pressure in the pressurization annulus 31. The amount of pressure can be controlled at the rig floor, for example, by controlling the fluid flow into the pressurization annulus 31 via the fluid inlet 33 or out of the pressurization annulus 31 via a fluid outlet (not shown), or via a valve (not shown). The amount of pressure can be controlled manually or it can be controlled by an automatic control module.

According to an embodiment, the methods include the step of applying a pressure differential between the mill advancing device 30 and the mill 20, wherein the application of the pressure differential causes a downward movement of the mill advancing device 30 and the mill 20. The amount of pressure in the pressurization annulus 31 can be a first pressure and the amount of pressure in the casing annulus 42 can be a second pressure. The first pressure can be the pressure exerted on the mill advancing device 30 and the second pressure can be the pressure at the location of the mill 20. For example, the second pressure can be the fluid pressure from a drilling fluid in the casing annulus 42. According to an embodiment, the pressure differential is caused by creating a higher first pressure compared to the second pressure. As such, the amount of pressure in the pressurization annulus 31 can be greater than the amount of pressure in the casing annulus 42. The first pressure can be greater than the second pressure, for example, by introducing a higher density fluid into the pressurization annulus 31 and introducing a lower density fluid into the casing annulus 42. It may be advantageous to include a lower density fluid (e.g., a drilling fluid) in the casing annulus 42 in order to decrease the amount of torque or drag on the mill advancing device 30 as it advances through in the wellbore. The amount of torque or drag can be reduced by the buoyancy of the drilling fluid compared to a fluid introduced into the pressurization annulus 31. The pressure differential can be calculated by subtracting the second pressure from the first pressure. According to an embodiment, the calculated pressure differential is a positive number. The pressure differential can cause a downward movement (in the direction of $d_1$) of the mill advancing device 30, for example by the application of a higher pressure in the pressurization annulus 31. When the pressure in the pressurization annulus 31 reaches a minimum pressure, the mill advancing device 30 can begin to move in a downward direction towards the mill diverter 22. According to an embodiment, once the window is completed, or it is otherwise necessary to remove the mill 20 from the wellbore 12, the positive pressure differential can be reversed such that the second pressure is greater than the first pressure. In this manner, the higher second pressure can be used to push the mill 20 up the wellbore 12.

The methods include the step of causing the mill 20 to engage the at least the portion of the cased wellbore. According to an embodiment, movement of the mill advancing device 30 causes movement to the drill string 21, and movement of the drill string 21 causes movement of the mill 20. In this manner, the mill advancing device 30 is connected to the drill string 21 in a manner such that movement of the mill advancing device 30 causes movement of the drill string 21. The step of causing can include causing movement of the mill advancing device 30. The movement of the of the mill advancing device 30 can be caused by applying the pressure differential between the mill advancing device 30 and the mill 20. This relationship of connections between the mill advancing device 30, the drill string 21, and the mill 20 means that movement of the mill 20 does not have to occur by applying a force to the top of the drill string 21, wherein the mill 20 would be susceptible to inadvertent or undesirable movement (for example in rough seas). By being able to cause movement of the mill 20 via movement of the mill advancing device 30, a window can be milled in a more controlled manner.

The methods can further include the step of introducing a drilling fluid into the wellbore. The drilling fluid can be used to aid the mill bit in milling the window in the portion of the cased wellbore. As can be seen in FIG. 1, the well system can further include an inner tubing string 40 and can also include one or more return fluid channels 41. According to an embodiment, the inner tubing string 40 has a constant inner diameter (I.D.). The constant I.D. of the inner tubing string 40 can be used to help better circulate and remove fluids from the casing annulus 42 during the milling operation. By way of example, and as can be seen in FIG. 1, a drilling fluid can be introduced down the drill string 21 to the mill 20. The drilling fluid can exit the mill 20 in the direction of $d_2$. The drilling fluid can then continue flowing in the directions $d_2$ in the casing annulus 42. The drilling fluid can then enter and flow through the return fluid channel 41 and into the inner tubing string 40. The drilling fluid can then be returned to the rig platform via the inner tubing string 40.

According to an embodiment, the location of the mill advancing device 30 above the mill 20 has a maximum distance. According to an embodiment, the maximum distance is selected such that the mill advancing device 30 is located in the same sized tubular as the mill 20. The maximum distance can vary depending upon the I.D. of the casing 14 above the mill advancing device 30, so that the mill advancing device remains in a tubing string that has an I.D. that is not too large for the mill advancing device to create a seal. The maximum distance could also be limited due to the possibility of buckling the drill string 21 between the mill advancing device 30 and the mill 20. The distance between the mill advancing device 30 and the mill 20 can also have a minimum distance. According to an embodiment, and as can be seen in FIG. 3, the minimum distance is at least a distance such that after the window has been completed, the mill advancing device 30 is not located below the beginning of the window 24. According to another embodiment, the minimum distance is selected such that fluid pressure in the pressurization annulus 31 is not reduced or lost during milling operations. For example, the mill advancing device 30 does not enter any portion of the milled window. In this manner, the seal created by the mill advancing device 30 is not jeopardized. The seal helps to ensure that the pressure in the pressurization annulus 31 is maintained. In the event it becomes necessary to slow or stop the downward movement of the mill advancing device 30 and the mill 20, then the pressure can be relieved from the pressurization annulus 31, for example, via a valve (not shown).

The methods can further include the step of completing the window in the at least a portion of the cased wellbore, wherein the step of completing can be performed after the step of causing the mill to engage the at least the portion of the cased wellbore. FIG. 3 illustrates a completed window according to an embodiment. The step of applying the pressure differential can include applying the pressure differential until the step of completing the window has been performed. The methods can further include the step of stopping application of the pressure differential. The step of stopping can be performed after the step of causing or after the step of completing the window. The methods can further include the step of removing at least the mill advancing device 30 and the mill 20 from the wellbore 12. The methods can also include the step of removing the mill diverter 22 from the wellbore 12. The steps of removing can be performed after the step of causing or after the step of completing the window or after the step of stopping the application of the pressure differential. The methods can further include the step of controllably milling more than one window in more than one portion of a cased wellbore. For example, a first window can be milled off of a primary wellbore to form a first lateral wellbore and a second window can be milled off of the first lateral wellbore, more than one window can be milled off of the primary wellbore, or more than one window can be milled off of a lateral wellbore. Of course, a network of wellbores can be formed by milling multiple windows in multiple wellbores. When milling multiple windows in a single wellbore, the windows could be milled in a bottom-up fashion by forming the lowest most window first and then proceeding up the wellbore where another window is then milled, and so on. According to another embodiment, multiple windows could be milled in a top-down fashion by forming a first window, moving or engaging the seal 32 farther down in the wellbore, and then proceeding down the wellbore where another window is then milled, and so on.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of controllably milling a window in at least a portion of a cased wellbore comprising:

interconnecting a mill advancing device and a mill, wherein the mill advancing device is slidingly connected to a casing of the cased wellbore;

creating a pressure differential between an area above the mill advancing device and an area below the mill advancing device, wherein the creation of the pressure differential causes a downward movement of the mill advancing device and the mill; and causing the mill to engage the at least a portion of the cased wellbore.

2. The method according to claim 1, wherein the mill advancing device moves downwards or upwards along the inside of the casing.

3. The method according to claim 1, further comprising a mill diverter, wherein the mill diverter is located in the casing adjacent to the portion of the cased wellbore.

4. The method according to claim 3, further comprising securing the mill diverter in the casing adjacent to the portion of the cased wellbore, wherein the step of securing is performed prior to the step of creating the pressure differential.

5. The method according to claim 1, wherein the mill advancing device is interconnected to the mill such that movement of the mill advancing device causes movement of the mill.

6. The method according to claim 5, wherein the mill advancing device is interconnected to the mill via a drill string.

7. The method according to claim 6, wherein the mill advancing device is connected to the drill string such that a seal is created between the outer diameter of the drill string and the inner diameter of the mill advancing device.

8. The method according to claim 6, wherein the mill advancing device is connected to the drill string such that movement of the mill advancing device causes movement of the drill string.

9. The method according to claim 1, further comprising a seal, wherein the seal is located above the mill advancing device.

10. The method according to claim 9, wherein the seal and the mill advancing device create a pressurization annulus, wherein the pressurization annulus is an area between the outside of a drill string and the inside of a casing of the cased wellbore.

11. The method according to claim 10, wherein the pressurization annulus is located between the bottom of the seal and the top of the mill advancing device.

12. The method according to claim 11, further comprising a fluid inlet.

13. The method according to claim 12, wherein a fluid can be introduced into the pressurization annulus via the fluid inlet.

14. The method according to claim 13, further comprising a casing annulus, wherein the casing annulus is located below the mill advancing device, wherein the casing annulus is an area between the outside of a drill string and the inside of a casing of the cased wellbore, and wherein the mill is attached to a portion of the drill string that is located within the casing annulus.

15. The method according to claim 14, wherein the amount of pressure in the pressurization annulus is a first pressure and the amount of pressure in the casing annulus is a second pressure.

16. The method according to claim 15, wherein the fluid is used to create the first pressure.

17. The method according to claim 15, wherein the pressure differential is caused by creating a greater first pressure compared to the second pressure.

18. The method according to claim 1, wherein the step of creating comprises causing movement of the mill advancing device.

19. The method according to claim 1, further comprising completing the window in the at least a portion of the cased wellbore, wherein the step of completing is performed after the step of causing the mill to engage the at least the portion of the cased wellbore.

20. The method according to claim 19, further comprising stopping creation of the pressure differential, wherein the step of stopping is performed after the step of causing or after the step of completing the window.

21. The method according to claim 1, further comprising controllably milling more than one window in more than one portion of the cased wellbore.

22. The method according to claim 1, wherein the mill advancing device is connected to the casing such that a seal is created between the outside of the mill advancing device and the inside of the casing.

23. A method of controlling a mill in a cased wellbore comprising:

interconnecting a mill advancing device and the mill, wherein the mill is connected to a drill string that is located inside the cased wellbore;

creating a seal between the outside of the drill string and the inside of a casing of the cased wellbore at the location of the mill advancing device; and creating a pressure differential between an area above the seal and an area below the seal, wherein the creation of the pressure differential causes a downward movement of the mill advancing device, the seal, and the mill.

* * * * *